US006875136B2

(12) United States Patent
Leal et al.

(10) Patent No.: US 6,875,136 B2
(45) Date of Patent: Apr. 5, 2005

(54) SYSTEM FOR, AND METHOD OF POPPING UPWARDLY AN ELEMENT ON A T-BALL MECHANISM

(75) Inventors: Jose E. Leal, Stow, MA (US); Hans E. Leal, Stow, MA (US); John F. Barletta, Southborough, MA (US)

(73) Assignee: Sport Fun, Inc., Los Angeles, CA (US)

( * ) Notice: Subject to any disclaimer, the term of this patent is extended or adjusted under 35 U.S.C. 154(b) by 108 days.

(21) Appl. No.: 10/135,136

(22) Filed: Apr. 30, 2002

(65) Prior Publication Data

US 2003/0203773 A1 Oct. 30, 2003

(51) Int. Cl.[7] ..... A63B 69/00; F41B 7/00

(52) U.S. Cl. ..... 473/451; 473/417; 473/422; 124/54; 124/16

(58) Field of Search ..... 473/415, 417, 473/422, 451, 131, 136, 137, 418, 196, 202, 102, 103; 273/317, 317.7, 105, 108.3; 124/1, 16, 50, 78, 49, 34, 48

(56) References Cited

U.S. PATENT DOCUMENTS 3,915,143 A * 10/1975 Waller ..... 124/77
4,282,848 A * 8/1981 Kulesza et al. ..... 124/16
4,291,665 A * 9/1981 Bash et al. ..... 124/56
4,915,384 A * 4/1990 Bear ..... 473/451
5,294,109 A * 3/1994 Meade ..... 124/54
5,462,285 A * 10/1995 O'Patka et al. ..... 273/459
5,590,876 A * 1/1997 Sejnowski ..... 473/417
5,800,288 A * 9/1998 Mims ..... 473/417
D423,060 S * 4/2000 Clark et al. ..... D21/483
6,099,417 A * 8/2000 Brown et al. ..... 473/417
6,176,230 B1 * 1/2001 Thompson ..... 124/16
6,190,271 B1 * 2/2001 Rappaport et al. ..... 473/451
6,371,871 B1 * 4/2002 Rappaport et al. ..... 473/457
6,416,429 B1 * 7/2002 Pecoraro et al. ..... 473/417
6,443,859 B1 * 9/2002 Markin ..... 473/451
6,695,723 B2 * 2/2004 Leal et al. ..... 473/417

* cited by examiner

*Primary Examiner*—Mitra Aryanpour
(74) *Attorney, Agent, or Firm*—Fulwider Patton; Ellsworth R. Roston

(57) ABSTRACT

A transmitter in a member (e.g. bat) transmits signals when a switch on the bat is pressed. A pop-up apparatus receives the signals. A member in the apparatus prevents an element (e.g. ball) from being popped upwardly in a first positioning of the member and provides for the element pop-up in a second positioning of the member. Normally disposed in the first position, the member is operable to the second position by the received signals. The apparatus includes a housing and a bin pivotally coupled to the housing to hold the element. The bin provides for a substantially vertical element pop-up in a first pivotal position and for an element pop-up with a horizontal component in a second position. In the vertical pop-up, a player hits the ball with the bat. In the other pop-up, the player catches the ball.

14 Claims, 8 Drawing Sheets

SYSTEM FOR, AND METHOD OF POPPING UPWARDLY AN ELEMENT ON A T-BALL MECHANISM

This invention relates to apparatus for, and methods of, providing an opportunity for young children to hit and catch an element such as a ball. More particularly, the invention relates to apparatus for, and methods of, popping upwardly the element (e.g. the ball) upwardly in a substantially vertical direction to provide practice for a young child to hit the ball with a member (e.g. a bat) and for popping the ball upwardly with a horizontal component to provide practice for the child to catch the ball.

BACKGROUND OF THE PREFERRED EMBODIMENTS OF THE INVENTION

Baseball is a national pastime in the United States and in a number of foreign countries including Japan, Mexico, Cuba and the Dominican Republic. Children as young as 3 or 4 years old attempt to swing a bat against a ball or catch a ball. Parents and grandparents and older brothers and sisters attempt to help the child develop skills in hitting and catching a ball. The most common way of providing this help is to provide a T-ball stick disposed in a base member. The stick has at its upper end a cup for receiving and holding a ball. When the ball is disposed in the cup, the child swings a bat against the ball to propel the ball from the tee. To help a child in learning how to catch the ball, the ball is thrown gently by a parent to the child from a relatively short distance. At a more advanced age, the child practices batting by swinging the bat against the ball when the ball is thrown gently toward him from a relatively short distance.

In both hitting and catching, someone closely related to the child (e.g. a parent or grandparent) has to place the ball on the tee or throw the ball gently toward the child. This creates inconveniences, particularly when a young child in the age range of 3 to 6 years old is involved. In addition, the procedure is inefficient since considerable time is lost between the successive times that the ball is thrown gently to the child. This is particularly true when the number of balls used in the batting or catching practice is limited.

BRIEF DESCRIPTION OF A PREFERRED EMBODIMENT OF THE INVENTION

In a preferred embodiment of the invention, a transmitter in a member (e.g. bat) transmits signals when a switch on the bat is pressed. A pop-up apparatus receives the signals. A member in the apparatus prevents an element (e.g. ball) from being popped up in a first positioning of the member and provides for the element pop-up in a second positioning of the member. Normally disposed in the first position, the member is operable to the second position by the received signals. The apparatus includes a housing and a bin pivotally coupled to the housing to hold the element. The bin provides for a substantially vertical element pop-up in a first pivotal position and for a pop-up with a horizontal component in a second position. In the vertical pop-up, a player hits the ball with the bat. In the other pop-up, the player catches the ball.

BRIEF DESCRIPTION OF THE DRAWINGS SHOWING A PREFERRED EMBODIMENT OF THE INVENTION

Figure 10:
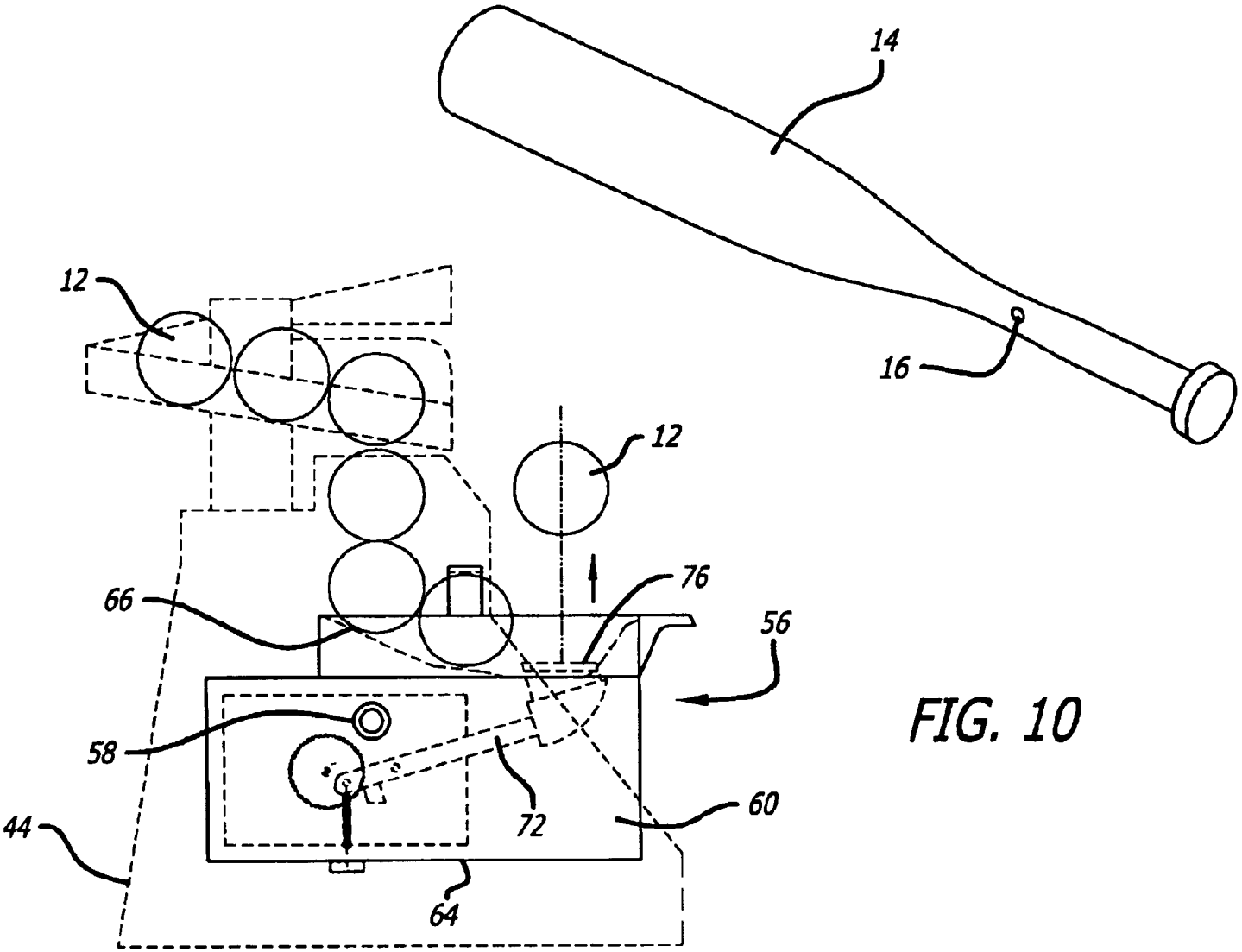
FIG. 10 is a front elevational view showing the bat also shown in FIG. 1 and showing partially schematically the bin and the apparatus in the bin in one pivotable position for popping the ball in the bin vertically upwardly to be propelled by the bat.
Figure 12:
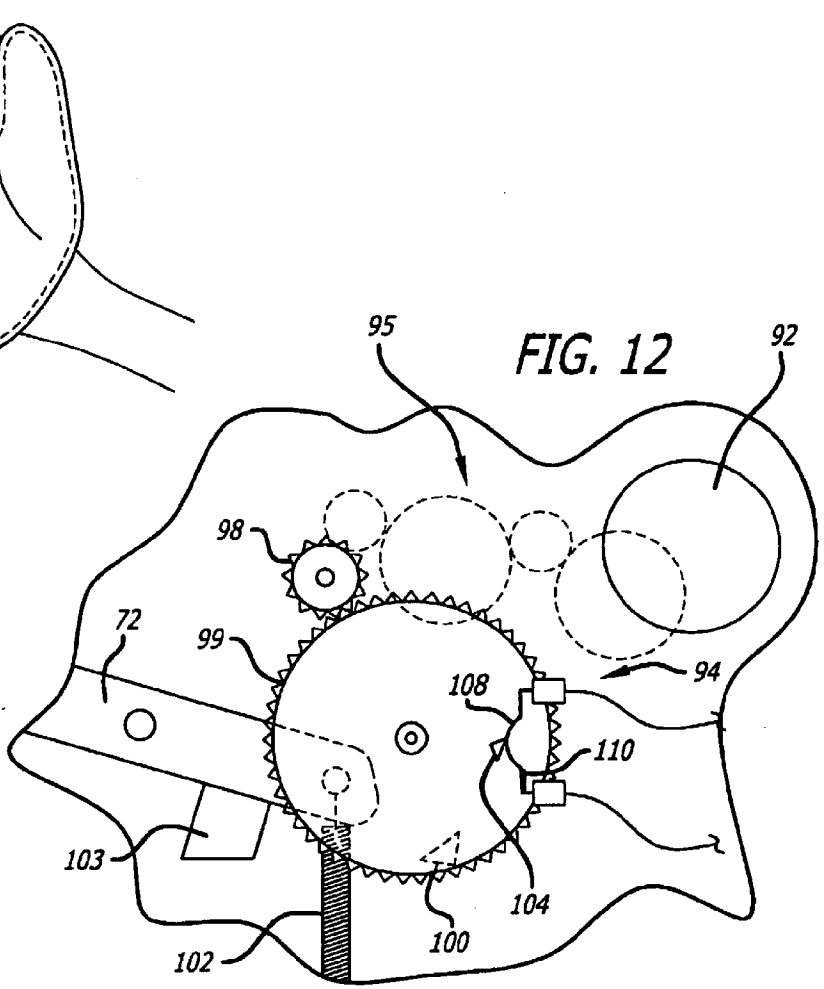
Figure 11:
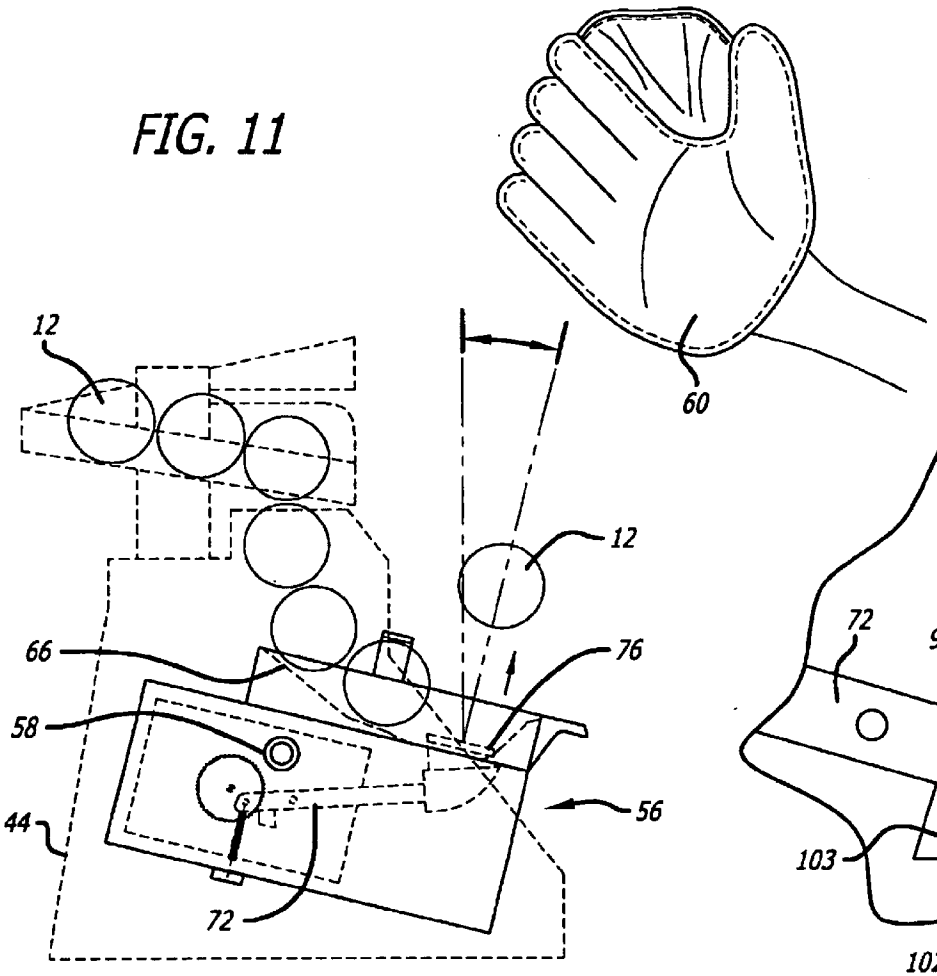

FIG. 11 is a front elevational view similar to that shown in FIG. 10 and showing, partially schematically, the bin and the apparatus in the bin in a second pivotable position, different from that shown in FIG. 10, to provide for a pop-up of the ball upwardly with a horizontal component to provide for a catching of the ball by the player; and FIG. 12 is an enlarged fragmentary schematic view showing the relative positions of a switch and associated members when the members are in a position to close the switch, the switch being operative to discontinue the cyclic movement of the actuating member when the switch is closed.

DETAILED DESCRIPTION OF A PREFERRED EMBODIMENT OF THE INVENTION

Figure 1:
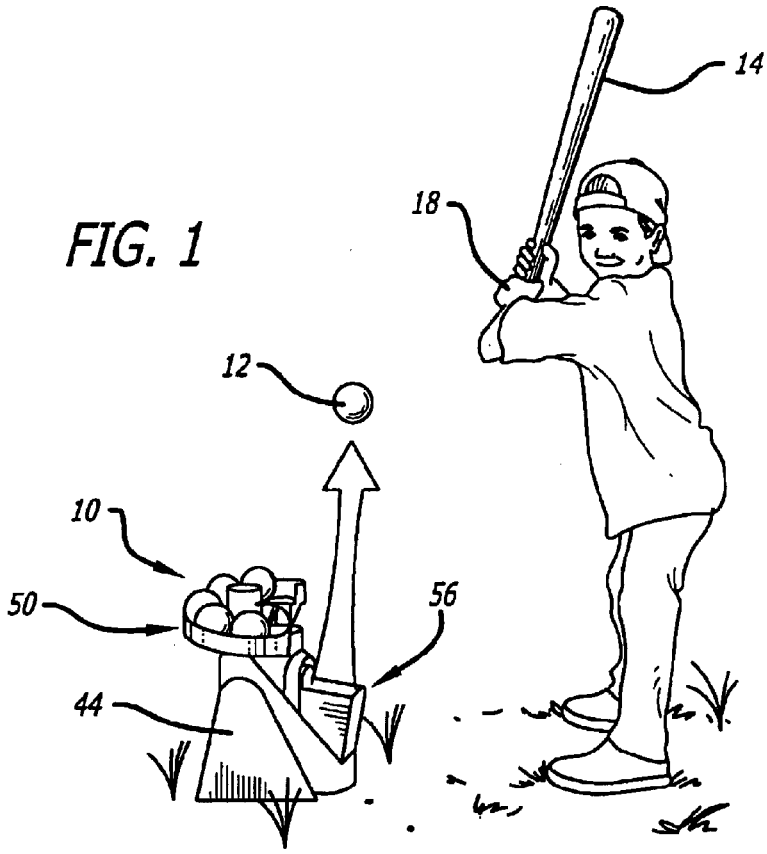
FIG. 1 is a schematic prospective view of a pop-up T-ball apparatus constituting a preferred embodiment of the invention and also showing a child holding a propulsion member (e.g., a bat) for striking an element (e.g., a ball) when the ball is popped upwardly from the apparatus.

In a preferred embodiment of the invention, apparatus generally indicated at 10 (FIG. 1) is provided for popping an element (e.g. a ball 12) upwardly to provide practice to a young child (e.g. age 3 to 6 years) in hitting the ball with a propulsion member (e.g. a bat 14) or in catching the bail. Preferably the ball 12 is a hollow plastic ball having a A switch 16 (FIG. 10) is provided on the bat 14, preferably at a position above the position on the handle portion where the batter's hands 18 (FIG. 1) grip the bat when the batter is swinging at the ball 12. The bat 14 may be made from a relatively thin hollow plastic material having a relatively light weight to facilitate the swinging of the bat by the child player and to prevent anyone from being injured if he or she should be struck by the bat. The switch 16 is depressed by the batter when the batter desires to have the apparatus 10 pop the ball upwardly. Although it is preferred to provide the switch 16 on the bat 14, it will be appreciated that the switch may be displaced from the bat without departing from the scope of the invention.

Figure 7:
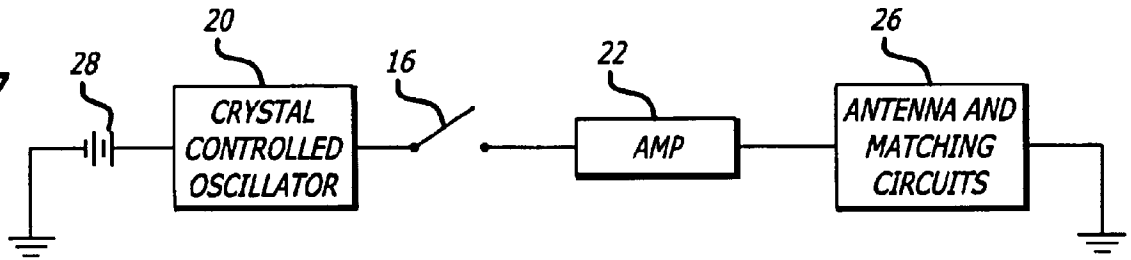
FIG. 7 is an electrical circuit diagram showing how signals are produced by a transmitter in the bat when a switch on the bat is manually closed.

An oscillator generally indicated at 20 in FIG. 7 is disposed in the bat 14, when the switch 16 is on the bat, to provide for the transmission of signals to the pop-up apparatus 10 for obtaining a pop-up of the ball 12 by the pop-up apparatus. In one embodiment, the oscillator 20 may be crystal controlled for producing signals at a particular frequency such as approximately thirty-two megahertz (32 MHz). When the switch 16 is displaced from the bat 14, the oscillator 20 is correspondingly displaced. The signals from the oscillator 20 may be amplified as at 22 and the amplified signals may be introduced to an antenna 26 which may be provided with an impedance preferably matching the impedance of the amplitier 22. An energy source such as a battery 28 (FIG. 7) may be removably disposed in the bottom of the bat to energize the oscillator 20. The antenna and matching circuits 26, the amplifier 22 and the battery 28 may be disposed within the bat 14 when the switch 16 and the oscillator 20 are respectively disposed on and in the bat.

Figure 8:
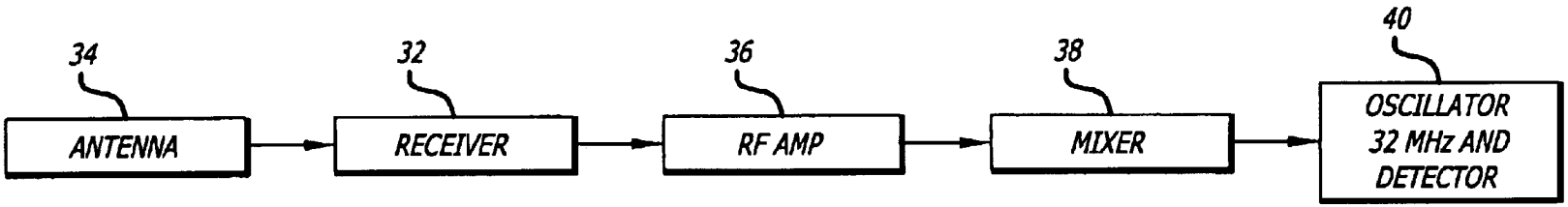
FIG. 8 is an electrical circuit diagram showing how the signals from the transmitter are received and processed at the pop-up T-ball apparatus.

A receiver generally indicated at 32 in FIG. 8 may be disposed in the pop-up apparatus 10 to receive the signals transmitted from the bat 14. The receiver 32 may include an antenna 34 which may be in the form of a coil. Amplifiers 36 may be provided to amplify the received signals. Since the signals are transmitted by the antenna 26 and are received by the antenna 34, they may be transmitted on a wireless basis. The amplified signals may then be mixed as at 38 and the mixed signals may then be detected as at 40 to recover the signals at thirty-two megahertz (32 MHz).

Figure 3:
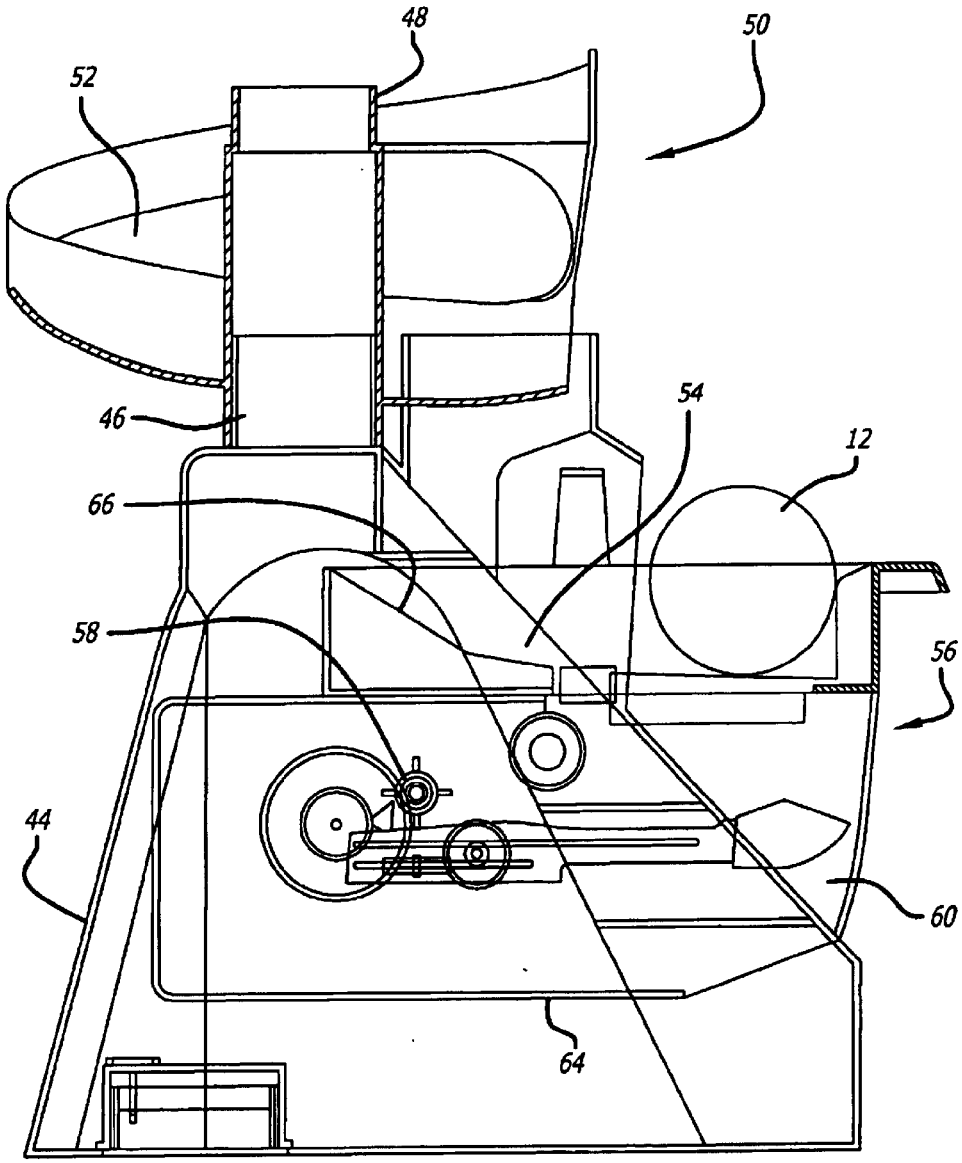
FIG. 3 is an enlarged front elevational view in section of the apparatus.

The apparatus 10 includes a housing 44. The housing 44 is provided at its upper end with a stanchion 46 (FIG. 3). A sleeve 48 included in a ramp generally indicated at 50 fits snugly on the stanchion 46 in a removable relationship to the stanchion. The ramp 50 defines an inclined track 52 extending downwardly in a spiral path to a position at its bottom end above a hollow cavity 54. A plurality of the balls 12 are disposed on the track 52 for a movement of each ball in sequence into the hollow cavity 54 when the ball previously in the cavity is popped upwardly by the apparatus 10.

A bin generally indicated at 56 is pivotally coupled as at 58 (FIGS. 10 and 11) to the housing 44. In one pivotable position (FIG. 10) of the bin 56, each of the balls 12 is popped upwardly substantially vertically to provide for the batter to hit the ball with the bat 14. In another pivotable position (FIG. 1) of the bin 56, the bin is tilted downwardly so that the ball 12 moves in a direction having a horizontal component when the ball is popped upwardly. This provides for the ball 12 to be caught by the player as indicated by a glove 60.

Figure 2:
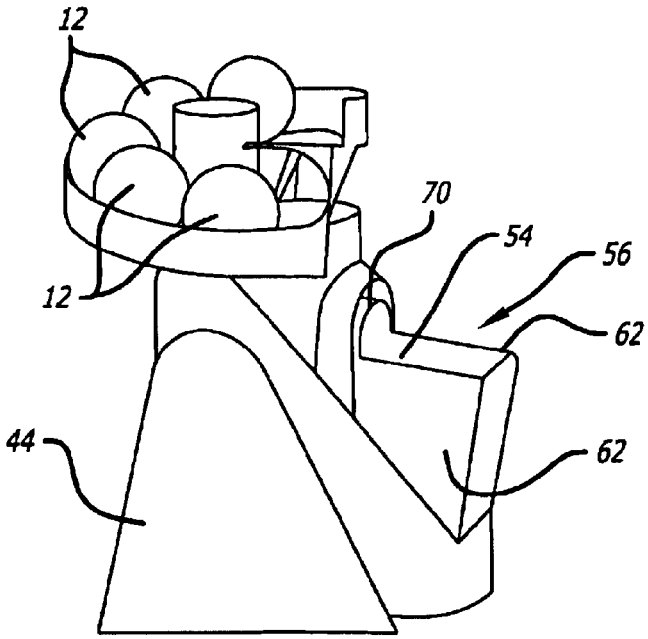
FIG. 2 is an enlarged perspective view of a ramp included in the T-ball apparatus for holding a number of the balls and for feeding each of the balls in sequence into a bin for a pop-up of the ball in the bin.

The cavity 54 is defined by a pair of side walls 62 (FIG. 2) and a bottom will 64 (FIGS. 4–6, 10 and 11). The cavity 54 is disposed to receive the ball 12 after the ball moves from the ramp 50. Guides 66 are disposed at spaced positions between the side walls 62 and extend downwardly at progressive positions between the back and front of the bin 56 to direct the ball 12 downwardly from the hollow passage 54 toward The front of the cavity 60. An opening 68 is provided in the lop wall 65 between the guides 66 at the front end of the cavity 60. A bridge 70 (FIG. 2) extends upwardly from the side walls 62 in an arched configuration. The bridge 70 confines each successive ball 12 within the cavity 54 so that the ball cannot fall out of the cavity.

An actuating member 72 (FIGS. 4–6 and 10–11) is pivotally disposed at its rear end in the bin 56. The actuating member 72 extends forwardly through the bin 56 to the opening 68. A hammer portion 74 (FIGS. 4–6, 10 and 11) extends upwardly from the free (or right) end of the actuating member 72. The hammer portion 74 is preferably tapered at its upper end as at 76 so that the force exerted by the hammer portion on the ball 12 will be concentrated when the hammer portion impinges on the ball. In the normal or rest position (FIGS. 4, 6 and 10) of the actuating member 72, the free (or right) end of the hammer portion 74 extends upwardly through the opening 68 in the bin 56 and prevents the ball 12 in the cavity from moving to a position above the opening. When the free (or right) end of the actuating member 72 is pivoted downwardly so that the hammer portion 74 is below the opening 68 (FIGS. 5 and 10), the ball 12 moves forwardly in the cavity 54 to a position above the opening 68.

Figure 9:
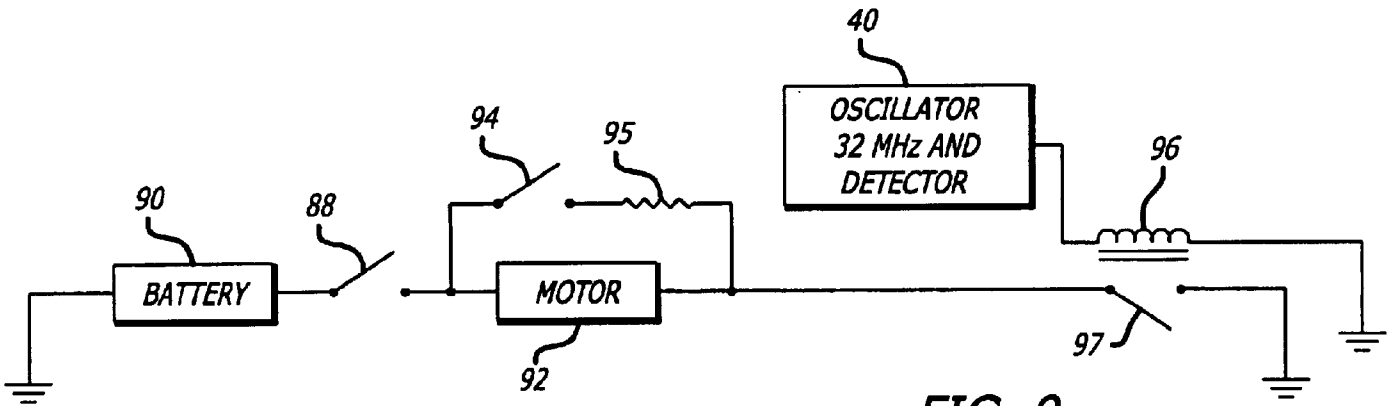
FIG. 9 is an electrical circuit diagram showing how a motor in the pop-up T-ball apparatus is energized when the signals are received by the receiver.

A manually operated switch 88 (FIG. 9) is disposed on the housing 44 to activate the pop-up apparatus 10 when the switch is manually closed. The switch 88 is connected in a circuit with a portable source of energy such as a battery 90 and with a motor 92 disposed in the bin 56. A normally open switch 94 (FIGS. 4–6 and 9) is connected in series with a low impedance 95 across the motor 92. The battery 90, the switch 88, the motor 92 and a switch 97 are in series. The switch 97 becomes closed when a coil 96 is energized by current from the oscillator or detector 40. When the switch 88 is manually closed and the switch 97 becomes closed as a result of the reception of signals by the receiver 32 and the production of signals by the oscillator and detector 40, a circuit is established which includes the battery 90, the switch 88, the motor 92 and the switch 97.

Figure 4:
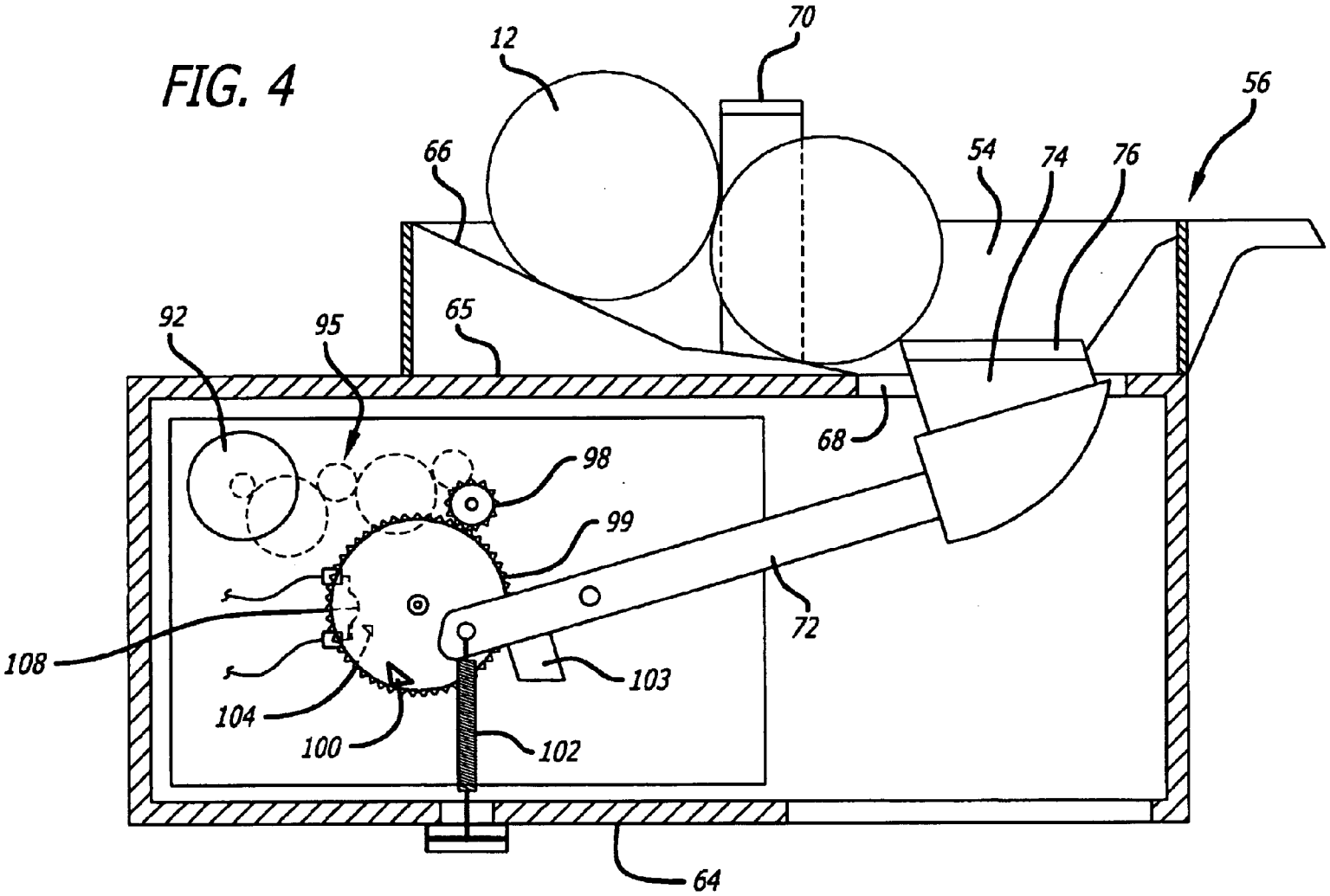
FIG. 4 is an enlarged elevational view, partially in section, of the bin and of an actuating member in the bin in a position for maintaining an element in the bin in a position preventing the element from being popped upwardly out of the bin.
Figure 5:
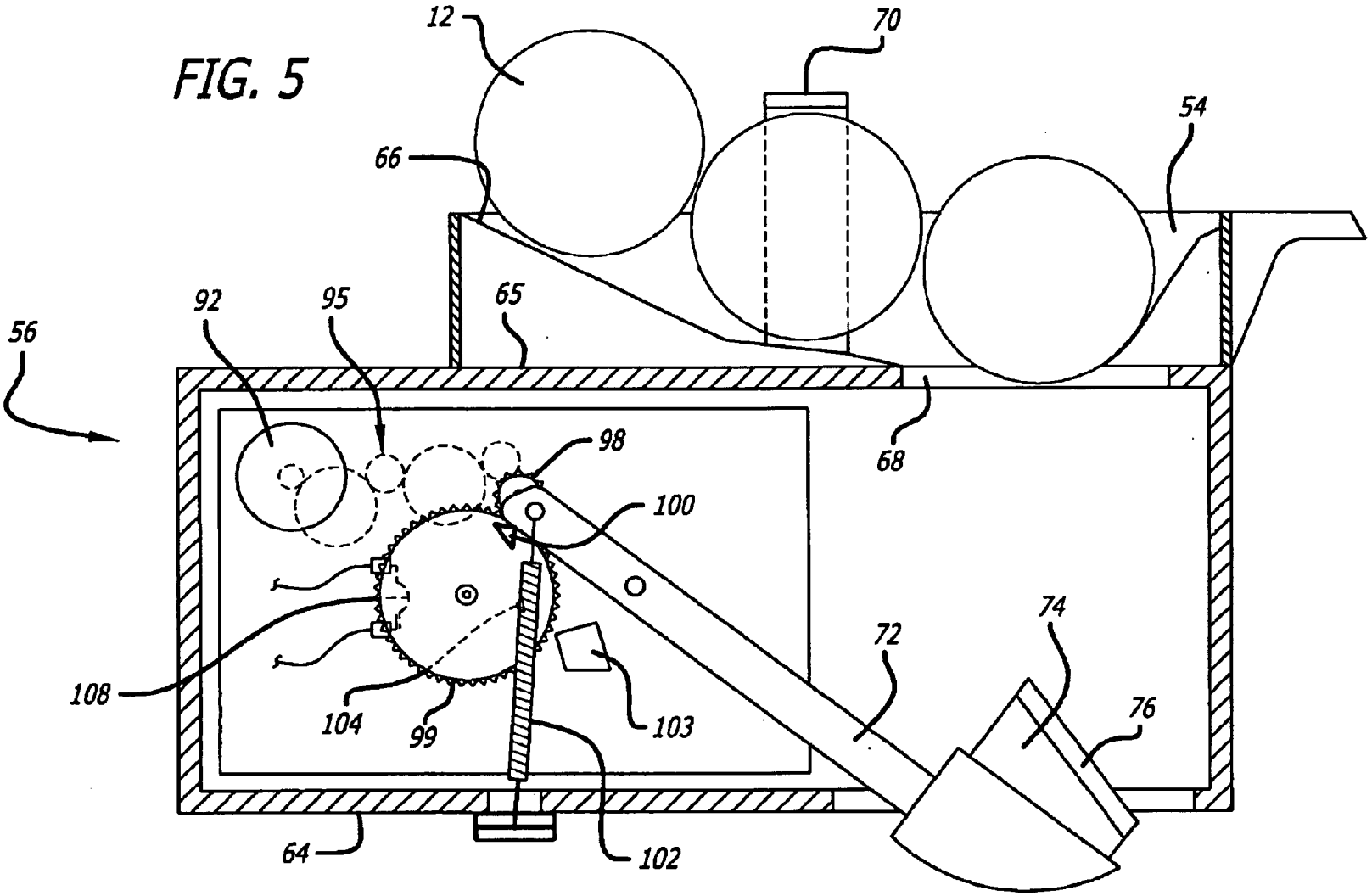
FIG. 5 is an enlarged elevational view, partially in section, similar to that shown in FIG. 4 but showing the actuating member moved to a position for providing for the pop-up of the element from the bin when the actuating member moves upwardly to impinge upon the element.
Figure 6:
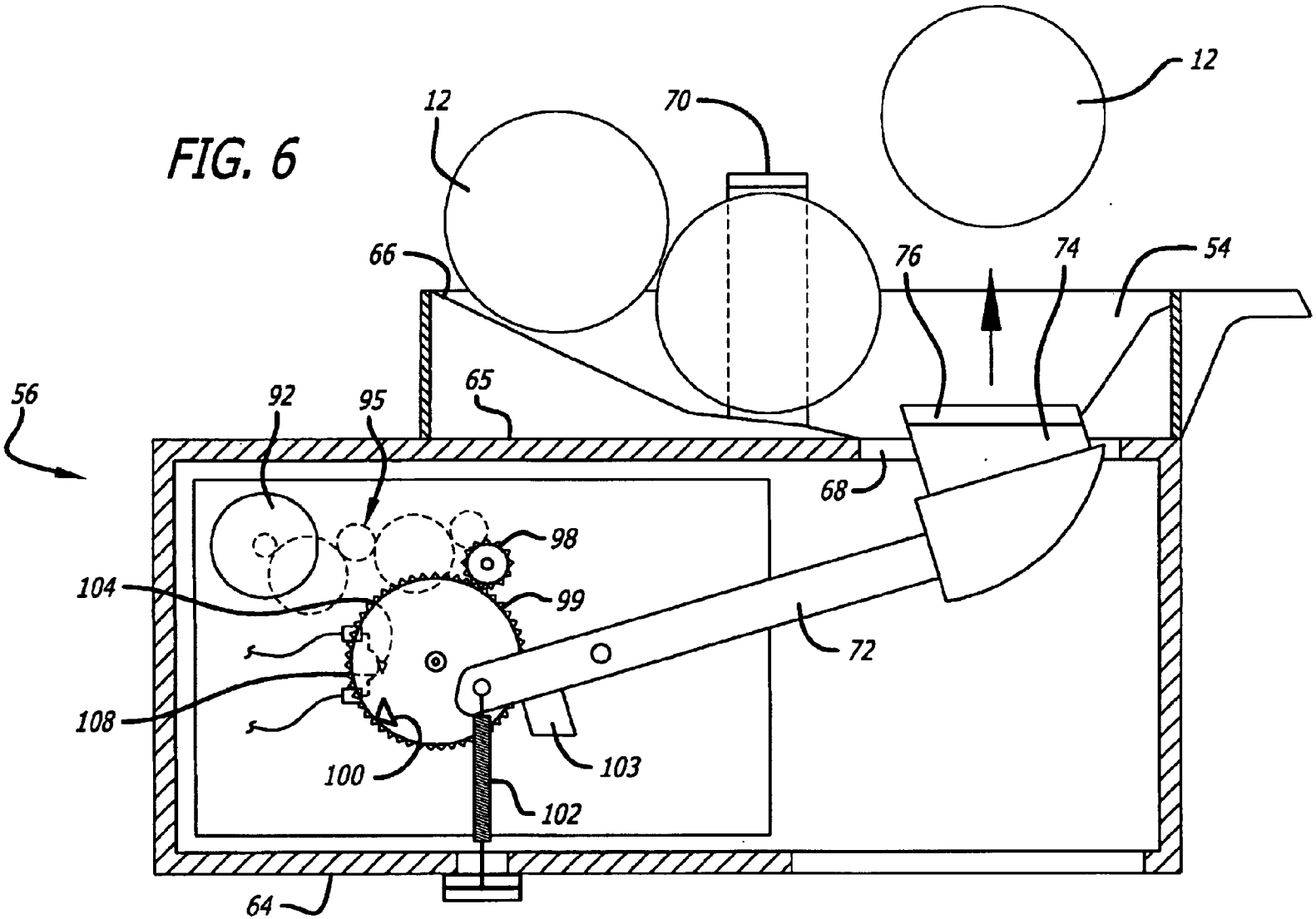
FIG. 6 is an enlarged elevational view, partially in section, similar to those shown in FIGS. 4 and 5 but showing the actuating member moved upwardly to the position for impinging against the ball in the bin and showing the ball popped upwardly from the bin.

When energized, the motor 92 drives a planetary gear arrangement generally indicated at 95 (FIGS. 4–6). The planetary gear arrangement rotates a pinion gear 98 which in turn rotates a drive gear 99 in a counterclockwise direction in FIGS. 4, 5 and 6. A drive member 100 on the front side of the drive gear 99 rotates with the drive gear 99 and engages the left end of the actuating member 72, thereby causing the left end of the actuating member to rise as the gear 99 rotates. This causes the free (or right) end of the actuating member 72 to move downwardly. This may be seen by a comparison in the positioning of the actuating member 72 in FIGS. 4 and 5 of the drawings.

A constrainable member such as a helical spring 102 is operatively coupled to the actuating member at the left end of the actuating member. The spring 102 is disposed in an unconstrained relationship in FIG. 4. As the drive gear 99 rotates in a counterclockwise direction in FIGS. 4, 5 and 6, the drive member 100 operates on the left end of the actuating member 72 to displace the actuating member from the position shown in FIG. 4 to the position shown in FIG. 5. As a result of the displacement of the right end of the actuating member 72, the element 12 in the cavity moves from the position shown in FIG. 4 to a position above the opening 68 as shown in FIG. 5.

In the position shown in FIG. 5, the drive member 100 is at a position where it is no longer coupled to the left end of the actuating member 72. This causes the actuating member to move instantaneously from the position shown in FIG. 5 to the position shown in FIG. 6. As a result of this movement, the ball 12 is popped upwardly as shown in FIG. 6. The movement of the actuating member 72 to this position is limited by a stop member 103 as shown in FIG. 6.

There is a lug 104 on the back side of the drive gear 99. When the lug 104 impinges on a switch contact 108 (FIGS.

5 and 12), it drives the switch contact 108 against a contact 110 to close-the switch 94, which is defined by the contacts 108 and 110. This causes the motor 92 in FIG. 9 to be short circuited so that no energy is provided to the motor. The motor then decelerates and stops at a position where it is ready to be energized for another cycle of operation when the switch 16 on the bat 14 is again closed. The position of the lug 104 in the stop position of the motor 92 is shown in FIG. 6. The drive gear 99, the drive member 100 and the lug 104 may be considered to be included in a control mechanism generally indicated at 120, which is cyclically rotatable. The drive gear 99 may be considered as a rotary member in the cyclically rotatable control mechanism 120.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the claims.

What is claimed is:

1. In a combination for operation with an element having properties of being propelled, a housing, a bin disposed in the housing and defining a cavity for receiving the element, the cavity being defined by spaced side walls and a bottom wall to receive the element and being open at the top, a spring disposed in the bin and having constrained and unconstrained relationships, an actuating member disposed in the bin and having first and second ends and attached to the spring at the first end and being pivotable at the second end between a position displaced from the cavity and a position extending into the cavity, the element being positioned in the cavity in displaced relationship to the actuating member in the constrained relationship of the spring and being positioned in the cavity in the unconstrained relationship of the spring to provide for the movement of the element upwardly from the cavity by the actuating member when the constraint on the spring is released, and a mechanism in the bin for providing a constraint of the spring and a subsequent release of the constraint on the spring, wherein the bin is pivotably disposed on the housing to adjust the direction in which the element is popped upwardly when the constraint on the actuating member is released.

2. In a combination for operation with an element having properties of being propelled, a housing, a bin disposed in the housing and defining a cavity for receiving the element, the cavity being defined by spaced side walls and a bottom wall to receive the element and being open at the top, a spring disposed in the bin and having constrained and unconstrained relationships, an actuating member disposed in the bin and having first and second ends and attached to the spring at the first end and being pivotable at the second end between a position displaced from the cavity and a position extending into the cavity, the element being positioned in the cavity in displaced relationship to the actuating member in the constrained relationship of the spring and being positioned in the cavity in the unconstrained relationship of the spring to provide for the movement of the element upwardly from the cavity by the actuating member when the constraint on the spring is released, and a mechanism in the bin for providing a constraint of the spring and a subsequent release of the constraint on the spring, a receiver for receiving signals to provide for the constraint of the spring and the subsequent release of the constraint on the spring, and a mechanism responsive to the received signals for constraining the spring and for subsequently releasing the constraint on the spring, wherein the bin is pivotably disposed on the housing to adjust the direction in which the element is popped upwardly when the constraint on the spring is released and wherein the bottom of the cavity is constructed to guide the element into the cavity to the position where the element is disposed above the actuating member when the spring becomes constrained and wherein the second end of the actuating member is constructed and disposed relative to the element to prevent the element from being disposed above the actuating member when the spring is unconstrained and wherein the actuating member is constructed to engage the element forcibly when the constraint on the spring is released.

3. In combination for operation with an element having properties of being propelled or caught, a hollow housing, a bin pivotably coupled to the housing and defining a cavity having an opening at the upper end of the cavity, an actuating member coupled to the bin at a first end and extending into the cavity to a position above the opening in the cavity at a second end, opposite to the first end with the actuating member in a rest position to prevent the element from being positioned in the opening, the actuating member being movable to a constraining position where the actuating member does not extend into the opening in the cavity, a constraining member operatively coupled to the actuating member for moving in response to the movement of the actuating member from the rest position to the constraining position and for releasing the actuating member from the constraining position for movement of the actuating member to the rest position, after the movement of the actuating member to the constraining position, to impact against the element in the opening, and a drive mechanism operatively coupled to the actuating member for operating the actuating member from the rest position to the constraining position and for releasing the actuating member from the constraining position for movement to the rest position, after the movement of the actuating member to the constraining position, to impact the actuating member against the element, the element being disposed in the cavity out of coupled relationship with the actuating member in the rest position of the actuating member and being movable into the opening in the cavity when the actuating member is moved to the constraining position.

4. In a combination as set forth in claim 3, the constraining member constituting a spring and the actuating member being pivotably coupled to the bin at the first end and being pivotable at the second end from the rest position in the cavity to the constraining position to provide for the subsequent movement of the actuating member in the cavity to pop up the element in the cavity.

5. In a combination as set forth in claim 3, a receiver disposed in the housing and responsive to signals transmitted to the receiver for energizing the drive mechanism to obtain a movement of the actuating member from the rest position to the constraining position.

6. In combination for operation with an element having properties of being popped upwardly and of being propelled or caught when it is popped upwardly, a circuit including a switch having first and second states of operation and normally disposed in the first state of operation and including a transmitter for transmitting signals upon a change in the operation of the switch from the first state to the second state, a pop-up apparatus including a hollow housing and a bin coupled to the housing and an actuating member coupled at one end to the bin and having first and second ends extending into the bin at a second end Opposite to the first end, the bin defining a cavity having an opening for receiving the element and the disposition of the actuating member in the cavity in the first operative position displacing the element from the opening in the cavity and the displacement of the actuating member from the first operative position providing for the disposition of the element in the opening of the cavity, a constraining member having constrained and unconstrained relationships and operatively coupled to the actuating member for providing a disposition of the actuating member in the first position in the constrained relationship of the constraining member and for providing a release of the actuating member from the first position to impact the element when the constraining member becomes unconstrained, the pop-up apparatus also including a cyclically movable control mechanism for disposing the second end of the actuating member in the bin in a constrained relationship at a position below the element in the housing cavity and for subsequently releasing the constraint on the actuating member to provide for an impacting movement of the actuating member against the element with a force to pop the element upwardly, the pop-up apparatus further including a receiver responsive to the signals from the transmitter for providing for the constraint on the actuating member and the subsequent release of the constraint on the actuating member.

the actuating member being provided at the second end with a hammer configuration to accentuate the force imposed upon the element when the actuating member strikes the element and to prevent the element from moving in the cavity in the first operative position of the actuating member to the position where it is struck by the actuating member.

7. In combination for operation with an element having properties of being popped upwardly and of being propelled or caught when it is popped upwardly, a circuit including a switch having first and second states of operation and normally disposed in the first state of operation and including a transmitter for transmitting signals upon a change in the operation of the switch from the first state to the second state, pop-up apparatus including a hollow housing and a bin coupled to the housing and an actuating member coupled at one end to the bin and having first and second operative relationships and extending into the bin at a second end opposite to the first end, the bin defining a cavity for receiving the element and the disposition of the actuating member in the cavity in the first operative relationship preventing the element from being popped upwardly from the cavity and the displacement of the actuating member from the first operative position providing for the disposition of the element in the opening of the cavity, the pop-up apparatus also including a constrainable member for disposing the second end of the actuating member in the bin in a constrained relationship at a position below the element in the housing cavity and for subsequently releasing the constraint on the second end of the actuating member to provide for a movement of the actuating member against the element to pop the element upwardly, the pop-up apparatus further including a receiver responsive to the signals from the transmitter for providing for the constraint on the constrainable member and the subsequent release of the constraint on the constrainable member, the bin being coupled to the housing for pivotable movement relative to the housing to a first position to provide for a pop-up of the element upwardly in a substantially vertical direction and to a second position to provide for a pop-up of the element with a horizontal component, the actuating member being provided at the second end with a hammer configuration to accentuate the force imposed upon the element when the actuating member impinges against the element and to prevent the element from moving in the cavity, in the first operative relationship of the actuating member, to the position where it is struck by the actuating member, the cavity in the bin being defined by a pair of side walls and a bottom wall, a bridge extending between the side walls to maintain the disposition of the element in the cavity when the actuating member is in the first operative relationship, and guides disposed on the bottom wall of the cavity to direct the element toward the actuating member.

8. In a combination for popping an element upwardly for propulsion or catching by a player, a bin having a cavity defined by side walls and a bottom wall and having an opening in the cavity, a structure coupled to the bin for introducing the element into the cavity in the bin, an actuating member having one end normally disposed in the cavity in the bin at a first position to prevent the element from being disposed directly above the opening in the bin, a rotary member, the actuating member being coupled to the rotary member for movement of the one end of the actuating member on a cyclic basis to a first position providing for the movement of the element to a position above the opening and then to a second position providing for an impingement of the actuating member against the element for a popping upwardly of the element from the bin, and a constrainable member operatively coupled to the one end of the actuating member to become constrained during the movement of the one end of the actuating member to the first position and to provide for a release of the constraint on the constrainable member for an impingement of the actuating member against the element.

9. In a combination as set forth in claim 8, a housing, a receiver disposed in the housing for receiving signals for actuating the rotary member to rotate.

10. In a combination as set forth in claim 9, wherein the rotary member is rotatable through a cycle of operation upon each receipt of the signals by the receiver and wherein the actuating member is initially movable to the first position, and is subsequently movable to the second position, upon each cyclic movement of the rotary member and wherein the constrainable member becomes constrained during each movement of the actuating member to the first position and the constraint of the constrainable member becomes released during each movement of the actuating member to the second position.

11. In a combination as set forth in claim 10, the actuating member being normally positioned in the cavity to prevent the element in the cavity from moving to a position above the opening in the cavity and being movable to the first position in accordance with the rotation of the rotary member to provide for the movement of the element to the position above the opening in the cavity.

12. In a combination as set forth in claim 9, including a propulsion member, a switch disposed on the propulsion member and normally disposed in a first position and manually operable to a second position, and a transmitter in the propulsion member and responsive to the disposition of the switch in the second position for transmission of signals to the receiver.

13. In a combination as set forth in claim 12, a ramp disposed on the housing for holding a plurality of the elements and for providing for the introduction of the elements in sequence into the cavity in the bin in accordance with successive dispositions of the switch in the second position.

14. In a combination as set forth in claim 13, wherein a receiver is disposed in the housing for receiving signals for actuating the rotary member to rotate and wherein the rotary member is rotatable through a cycle of operation upon each receipt of the signals by the receiver and wherein the actuating member is initially movable to the first position, and is subsequently movable to the second position, upon each cyclic movement of the rotary member and wherein the constrainable member becomes constrained during each movement of the actuating member to the first position and the constraint of the constrainable member becomes released during each movement of the actuating member to the second position and wherein the actuating member is normally positioned in the cavity to prevent the element in the cavity from moving to the position above the opening in the cavity and is movable to the first position in accordance with the rotation of the rotary member to provide for the movement of the element to the position above the cavity.

* * * * *

UNITED STATES PATENT AND TRADEMARK OFFICE

CERTIFICATE OF CORRECTION

PATENT NO. : 6,875,136 B2
DATED : April 5, 2005
INVENTOR(S) : Jose E. Leal et al.

It is certified that error appears in the above-identified patent and that said Letters Patent is hereby corrected as shown below:

Column 2,
Line 58, delete “bail” and insert -- ball --.
Line 59, after “having a” insert -- light weight and having spaced holes to limit the speed and travel distance of the ball. --.

Column 3,
Line 18, delete “amplitier” and insert -- amplifier --.
Line 62, delete “The” and insert -- the --.
Line 63, delete “lop” and insert -- top --.

Column 7,
Line 24, delete “Opposite” and insert -- opposite --.

Column 9,
Line 8, after “Claim 8,” add new paragraph before “a housing,”.

Signed and Sealed this

Twenty-third Day of August, 2005

JON W. DUDAS
*Director of the United States Patent and Trademark Office*